US011642569B2

(12) United States Patent
Zhang

(10) Patent No.: US 11,642,569 B2
(45) Date of Patent: May 9, 2023

(54) MULTIFUNCTIONAL ELECTRONIC RESISTANCE STRENGTH TRAINING FITNESS DEVICE

(71) Applicant: Macvon LLC, Moorestown, NJ (US)

(72) Inventor: Xing Zhang, Moorestown, NJ (US)

(73) Assignee: Macvon LLC, Moorestown, NJ (US)

( * ) Notice: Subject to any disclaimer, the term of this patent is extended or adjusted under 35 U.S.C. 154(b) by 239 days.

(21) Appl. No.: 17/323,370

(22) Filed: May 18, 2021

(65) Prior Publication Data

US 2022/0370854 A1 Nov. 24, 2022

(51) Int. Cl.

*A63B 24/00* (2006.01)
*A63B 21/00* (2006.01)
*A63B 21/005* (2006.01)

(52) U.S. Cl.

CPC ..... *A63B 24/0087* (2013.01); *A63B 21/0058* (2013.01); *A63B 21/151* (2013.01); *A63B 21/4035* (2015.10); *A63B 21/4045* (2015.10); *A63B 21/4034* (2015.10); *A63B 2024/0093* (2013.01); *A63B 2208/0242* (2013.01); *A63B 2220/805* (2013.01); *A63B 2220/833* (2013.01)

(58) Field of Classification Search

CPC ..... A63B 24/0087; A63B 21/0058; A63B 21/151; A63B 21/4035; A63B 21/4045; A63B 21/4034; A63B 2024/0093; A63B 2208/0242; A63B 2220/805; A63B 2220/833; A63B 23/03533; A63B 21/169

See application file for complete search history.

(56) References Cited

U.S. PATENT DOCUMENTS

| | | | | |
|---|---|---|---|---|
| 3,026,816 | A * | 3/1962 | Russo | A63G 21/20 105/148 |
| 7,966,941 | B1 * | 6/2011 | Brannan | B60T 11/046 104/53 |
| 8,234,980 | B2 * | 8/2012 | Boren | A63G 21/22 104/53 |
| 8,640,626 | B2 * | 2/2014 | Perry | F16H 7/18 472/49 |
| 10,092,788 | B2 * | 10/2018 | O'Brien | A63B 7/00 |
| 10,335,626 | B2 | 7/2019 | Orady et al. | |
| D862,205 | S * | 10/2019 | Bailey | D8/356 |
| 10,486,015 | B2 | 11/2019 | Valente et al. | |
| 10,589,163 | B2 | 3/2020 | Orady et al. | |
| 10,617,903 | B2 | 4/2020 | Orady et al. | |
| 10,639,521 | B2 | 5/2020 | Foley et al. | |
| 10,661,112 | B2 | 5/2020 | Orady et al. | |
| D893,286 | S * | 8/2020 | Xu | D8/360 |
| 10,792,539 | B1 | 10/2020 | Gilstrom et al. | |
| 10,874,905 | B2 | 12/2020 | Belson et al. | |
| 10,918,899 | B2 | 2/2021 | Gisin et al. | |

(Continued)

*Primary Examiner* — Andrew S Lo
*Assistant Examiner* — Andrew M Kobylarz

(57) ABSTRACT

An exercise device comprising a metallic box, two motors mounted at left and right sides of the box, a mirror touch screen, a camera, a loudspeaker, two motors mounted at the left and right bottom of the box, movable arms at slide tracks at both sides, a voltage transformer for the mirror touch screen, and four drive boards for four motors. All these four motors connect with gear reducers. Four carriages ride on both sides of slide tracks. The upper left and right two carriages provide support for upper limbs exercise. The lower left and right two carriages provide support for lower limbs exercise.

14 Claims, 5 Drawing Sheets

(56) References Cited

U.S. PATENT DOCUMENTS

| | | | | | |
|---|---|---|---|---|---|
| D920,083 | S | * | 5/2021 | Yu | D8/360 |
| D936,462 | S | * | 11/2021 | Cao | D8/360 |
| 2009/0223406 | A1 | * | 9/2009 | Smith | A63G 21/22 104/112 |
| 2011/0239898 | A1 | * | 10/2011 | Brown | B61B 12/02 29/428 |
| 2018/0001126 | A1 | * | 1/2018 | Klopman | A61B 5/681 |
| 2018/0326957 | A1 | * | 11/2018 | McGowan | A63G 21/22 |
| 2020/0014967 | A1 | | 1/2020 | Putnam | |
| 2020/0078640 | A1 | | 3/2020 | Putnam | |

* cited by examiner

MULTIFUNCTIONAL ELECTRONIC RESISTANCE STRENGTH TRAINING FITNESS DEVICE

BACKGROUND OF THE INVENTION

1. Field of the Invention

The present invention relates to multifunctional digital strength exercise devices, specifically to such devices comprising at least two motors to provide at least two variable resistances synchronously matching variable muscle strength for an exerciser's upper limbs and lower limbs during strength exercise.

2. Description of the Related Art

Muscular strength enhances overall body health. Lots of devices have been developed to enhance muscle strength. Muscular strength relates to an exerciser's ability to move and lift objects. The ability can be measured by how much force one can exert, and how much weight one can lift in a short period of time.

Methods for developing muscular strength and power include resistance training, such as weightlifting, bodyweight exercises, and resistance band exercises. Other options include running, cycling, and climbing hills.

Regardless of whether one would like to reduce fats, increase muscles, fight stress, or stay away from cardiac diseases, diabetes and cancers, strength training is always a core exercise. The strength training can stimulate secretion of hormones of body and increase basal metabolism.

When one lifts an object, his or her muscular fibers will be slightly torn, which accelerates a process called a muscular protein synthesis, in which the fibers will be repaired or enhanced by amino acids to resist future damages. Therefore, when the muscular fibers are frequently challenged, especially when one carries out regular weightlifting trainings, the fibers will be structurally adjusted to cope with such challenges. For example, the muscles will become larger and stronger, or more fatigue-resistant, so as to adapt to such challenges. It is because of continuous exploration and pursuit of people for theories and practices of strength trainings that modern strength exercise devices are continuously innovated and developed. For example, the advent of Keiser air resistance strength exercise devices is the result of continuous innovation and improvement. Comprehensive and in-depth penetration and intervention of modern high-tech theories and technologies in sports training field have become a major trend of modern competitive sports development. With advanced scientific theories and technologies, athletes can be cultivated and trained in a more systematic, scientific, and economic manner, so that various potentials of the athletes are brought to full play and best matched, significantly improving their sports achievements. At the same time, since modern high-tech strength exercise devices and traditional strength exercise devices have their own advantages, we should boldly use modern high-tech strength exercise devices in the sports trainings to try to explore a set of modern high-tech exercise devices, theories, and methods. In practice, traditional exercise devices, such as barbell, will bring large noise, low safety level, and high risk of injury to athletes. Conventional resistance training relies on application of force of gravity and thus is difficult to develop special strength. Further, muscles will have to adapt to the changes of resistances of the exercise devices. Those isokinetic camming devices (isokinetic training devices) achieve the object that resistance changes along with an acting force while limited in the explosive power trainings. These devices cannot develop some weak aspects due to its inertia in use.

Safety: those free weight devices in traditional devices have a lower level of safety, which is typically represented by barbell. Due to large weights of many barbells and no protection measures to be taken, severe injury or death may be caused in case of accidents.

Comprehensiveness: in traditional training devices, stationary devices usually train an individual muscle group, that is, only a particular muscle or muscle group can be trained. Thus, all devices in a gym should be practiced in order to train all muscles of body.

Functionality: in traditional training devices, most devices are used to train a muscle or muscle group of a body part. These devices have little help in improving body coordination, core strength and core stability except for increasing muscle circumference of a corresponding body part.

Convenience: in traditional devices, a stationary device or a free weight device usually occupies a larger ground area and has a large weight. Except for dumbbell and barbell, most of them are difficult to move in the designated location. Therefore, most people have to practice them in a gym. Furthermore, it is required to reset and adjust weights for each exercise according to actual requirements.

Ease of use: for traditional devices, some basic exercise knowledge is required in order to achieve better effect.

To provide a more efficient, multifunctional strength training device, while avoiding the undesirable factors and limitation of existing exercise devices, an innovative exercise device is provided.

SUMMARY OF THE INVENTION

One aspect of the present application is an exercise device comprising:

- a main body, which has an upper part, a lower part, and a front surface;
- at least two upper motors being of a cylinder style or cuboid style or polygon cuboid style, with the at least two upper motors being mounted at the upper part of the main body, and each of the upper motors being configured to produce adjustable and dynamic resistance;
- at least two gear reducers, with one of the two gear reducers being connected with one of the two upper motors, and the other one of the two gear reducers being connected with the other one of the two upper motors, and each of the at least two gear reducers having an axle;
- at least two spools, with one of the two spools being mounted on the axle of one of the at least two gear reducers, and the other one of the two spools being mounted on the axle of the other one of the at least two gear reducers;
- at least two movable arms slidably attached to the main body, with each of the movable arms comprising a rope having two ends, one end being connected to a handle, and the other end being connected to one of the at least two upper motors through one of the at least two spools, one of the two movable arms being connected with one of the at least two upper motors, and the other one of the movable arms being connected with the other one of the at least two upper motors;

at least two lower motors for facilitating moving the at least two moveable arms, with the at least two lower motors being mounted on the lower part of the main body, a display device disposed at the front surface of the main body, with the display device comprising an interactive touch screen; and an intelligent control system operably coupled with at least one of the display device, upper motors, and lower motors, with the intelligent control system comprising a central controller to control at least one of the upper motors, lower motors, and the display devices; and the device is mountable on a wall and/or is capable of standing alone on ground.

The display device may preferably comprise an electronic display layer to display video imagery of a fitness instructor. The display device may also preferably comprise a mirror reflection layer to reflect an image of a user opposite the display device.

The device may preferably further comprise a dismountable footboard attached on the lower part of the main body so that a user may lie on a bench with feet on the footboard to resist pull forces generated by the at least two upper motors and therefore train leg muscles of the user. The main body has a left side and right side. The left side comprises an upper left side and a right left side, and the right side comprises an upper right side and a lower right side. The device may preferably comprise a left slide track on the left side, and a right slide track on the right side, two lower carriages with one being slidably attached to the lower left side of the main body and the other one being slidably attached to the lower right side of the main body, and the dismountable footboard on the lower part of the main body through connection with the two lower carriages for facilitating lower body exercise.

The device may also preferably comprise two upper carriages with one being slidably attached to the upper left side of the main body and the other one being slidably attached to the upper right side of the main body, and the at least two movable arms slidably attached to the main body through connection with the two upper carriages for facilitating upper body exercise.

The device may preferably comprise at least two threaded rods operably coupled with the at least two lower motors for moving the arms up or down the left slide track and right slide track respectively at a desired position, with one threaded rod being disposed on the left side of the main body, and the other threaded rod being disposed on the right side of the main body.

The device may also comprise at least one camera disposed on the upper part of the main body, and the camera is configured to collect image and/or exercise information and/or data of the user.

Preferably, each of the at least two upper motors contains a sensor for counting velocity and step length.

At least one of the at least two upper motors may be a three-phase brushless direct-current (BLDC) motor or servo motor.

The device may preferably be configured with artificial intelligence (AI) to learn muscle strength of both an exerciser and to output personalized resistance weight for the exerciser.

The device may also preferably be configured to adjust the resistance through voice recognition technology.

The device may preferably be configured to output different resistances simultaneously by adjusting each of the at least two upper motors separately.

Each of the two upper motors and lower motors may be coupled with a drive board.

The at least two upper motors may be mounted horizontally, transversely, or vertically, preferably horizontally or transversely, more preferably horizontally.

The at least two lower motors may be mounted horizontally, transversely, or vertically, preferably horizontally or vertically, more preferably vertically.

In one embodiment of the present invention, this exercise device comprises a metallic box, two motors mounted at left and right sides of the box, a mirror touch screen, a camera, a loudspeaker, two motors mounted at the left and right bottom of the box, movable arms at slide tracks at both sides, a voltage transformer for the mirror touch screen, and four drive boards for four motors. All these four motors connect with gear reducers. Four carriages ride on both sides of slide tracks. The upper left and right two carriages provide support for upper limbs exercise. The lower left and right two carriages provide support for lower limbs exercise.

In general, the present invention disclosed herein provides a user with two-cylinder style or two-cuboid style or two-polygon cuboid style motors to generate electronic strength, rather than gravity, spring force and frictional force. At each side of the top of the device, a motor may connect with a spool through a short shaft. The spool connects with several pulley groups. A rope goes through the spool. A device arm is mounted on a small mobile carriage at each side. The arm can be adjusted to different positions at various angles and heights. A dismountable footboard is mounted on the lower right and left side carriage. A motor is at left and right bottom of the device. It drives a threaded rod to spin so as to bring the arm's deck to move up and down.

These motors are controlled by a computer to generate strengths electronically. Further, dual motors are used to produce strengths. In this way, during an exercise, the production, disappearance, change, duration and size of strength can be adjusted automatically, dynamically, instantaneously, and quickly according to the instant feedback of muscle strengths of upper and lower limbs of both sides of an exerciser, and thus high level of control can be realized. At the same time, different strengths can be distributed to four limbs of the exerciser, which conform to the needs of exercise. This is because strengths of two upper limbs and of two lower limbs may be different, for example, the left arm may be weaker than the right arm. With dual motor design, different strengths can be distributed to different arms. Thus, this custom solution can greatly improve training efficiency, thereby preventing the weak arm from receiving the same strength as the strong arm and avoiding fast fatigue and even strain.

The second aspect of the present application is a method of conducting muscle exercise, which comprises:

providing two intelligent upper motors for providing adjustable resistance;

providing two movable arms respectively operably coupled with the two intelligent upper motors;

providing a display device comprising a mirror reflection layer to reflect an image of a user opposite the display device and electronic display layer to display video imagery of a fitness instructor;

adjusting resistance of the two intelligent upper motors;

moving the two movable arms for the exercise based on instructions shown on the electronic display layer.

The step of adjusting resistance of the two intelligent upper motors may be conducted through voice command technology operably coupled with two intelligent upper motors.

The display device may further comprise an interactive touch screen to adjust resistance during exercise, and the step of adjusting resistance of the two intelligent upper motors may be conducted through the interactive touch screen.

The present invention has many new features, functions, and advantages, including:

1. two motors provide high-precision digital strength;
2. one same device may provide trainings to different muscle groups of upper and lower limbs and intensify training of core muscle groups well and exercise all muscles of the whole body;
3. switching can be performed freely between strength modes such as spotter, dynamic, concentric and eccentric directions etc.;
4. counterweights are provided for the left and right arms instantaneously according to requirements;
5. counterweights are provided for the left and right legs instantaneously according to requirements.
6. an appropriate number of exercises can be found.
7. muscle extremity appears in your anticipated next action, and the most appropriate weight lifted an anticipated number of times can be selected.
8. One can find a training pattern and progress to fit particular individual user.
9. with ease of fine adjustment, athletes will be helped to realize breakthrough under safe conditions;
10. it is fit for fast strength and explosive strength trainings;
11. the entire training process is monitored in real time;
12. it has a high level of safety;
13. with light weight and small volume, it can be used even in an obstacle-free space of only three or four square meters regardless of indoors or outdoors;
14. training can be directly carried out with lessons under the guidance of on-site coaches; and
15. when more than one person uses the same device, different personalized weight needs will be memorized, and in each exercise, the device will initialize to a personal exercise strength immediately after a personal account is entered.

DETAILED DESCRIPTION OF PREFERRED EMBODIMENTS

Figure 1:
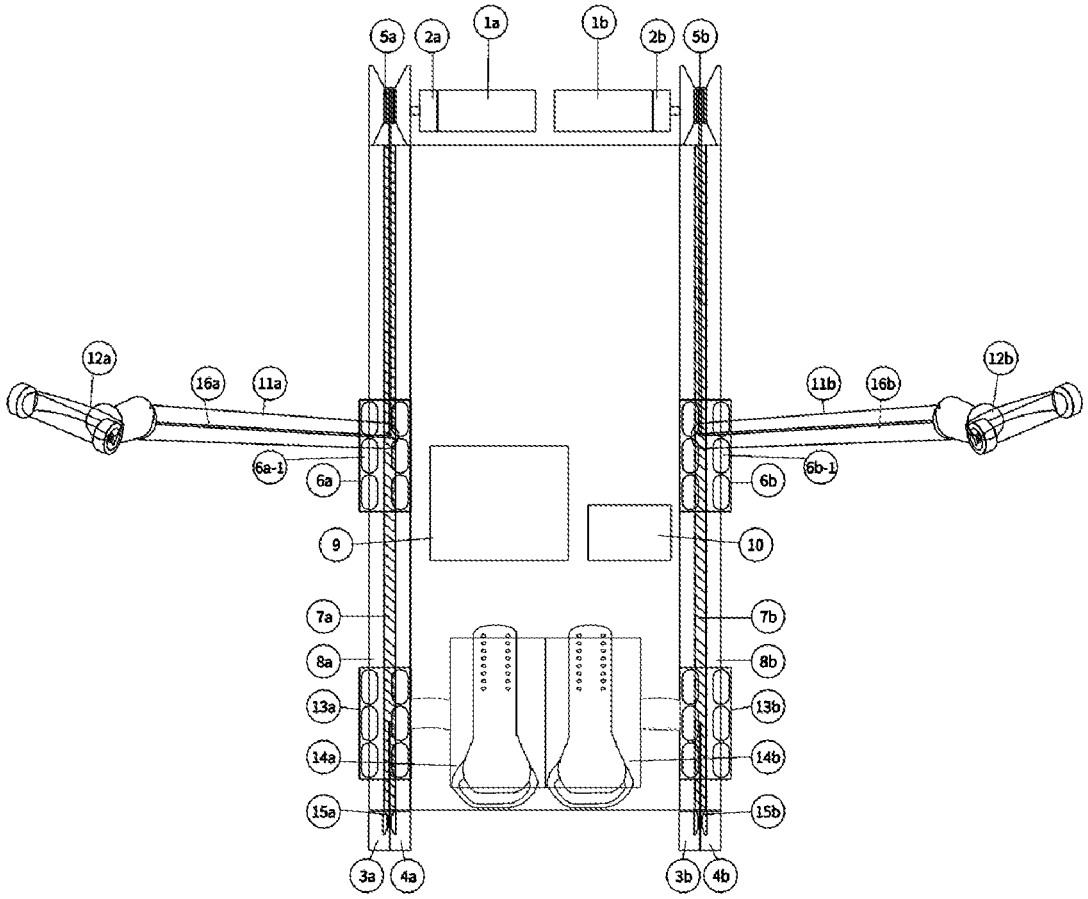
FIG. 1 shows a front view of an exercise device according to an embodiment of the present invention.
Figure 2:
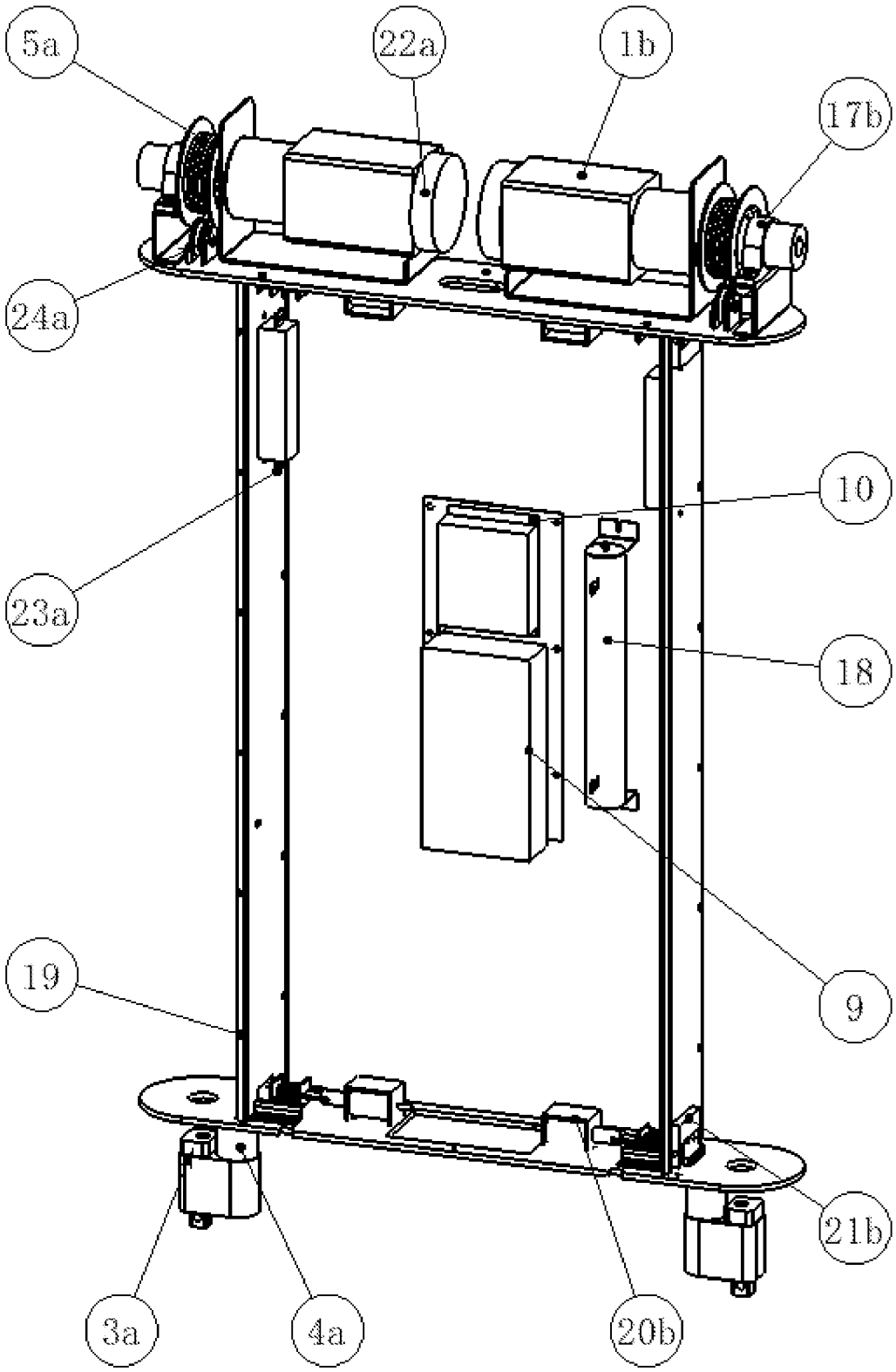
FIG. 2 shows a perspective view of FIG. 1, where arms, arm carriages, thread rod and slide track are omitted.
Figure 3:
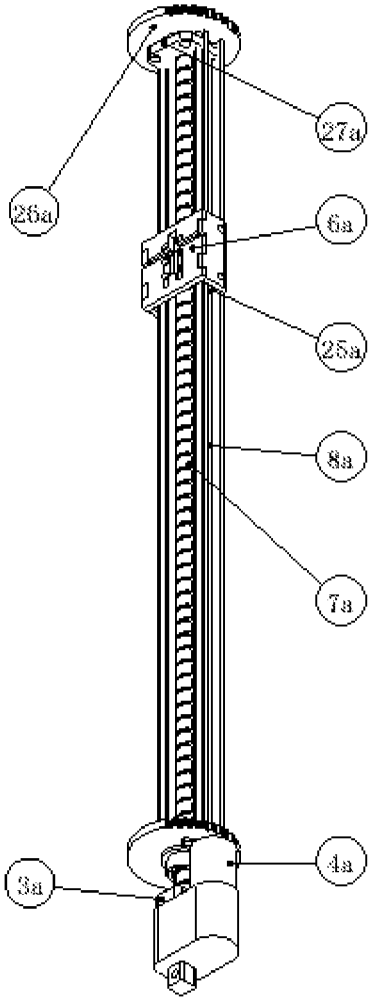
FIG. 3 shows one slide track.
Figure 4:
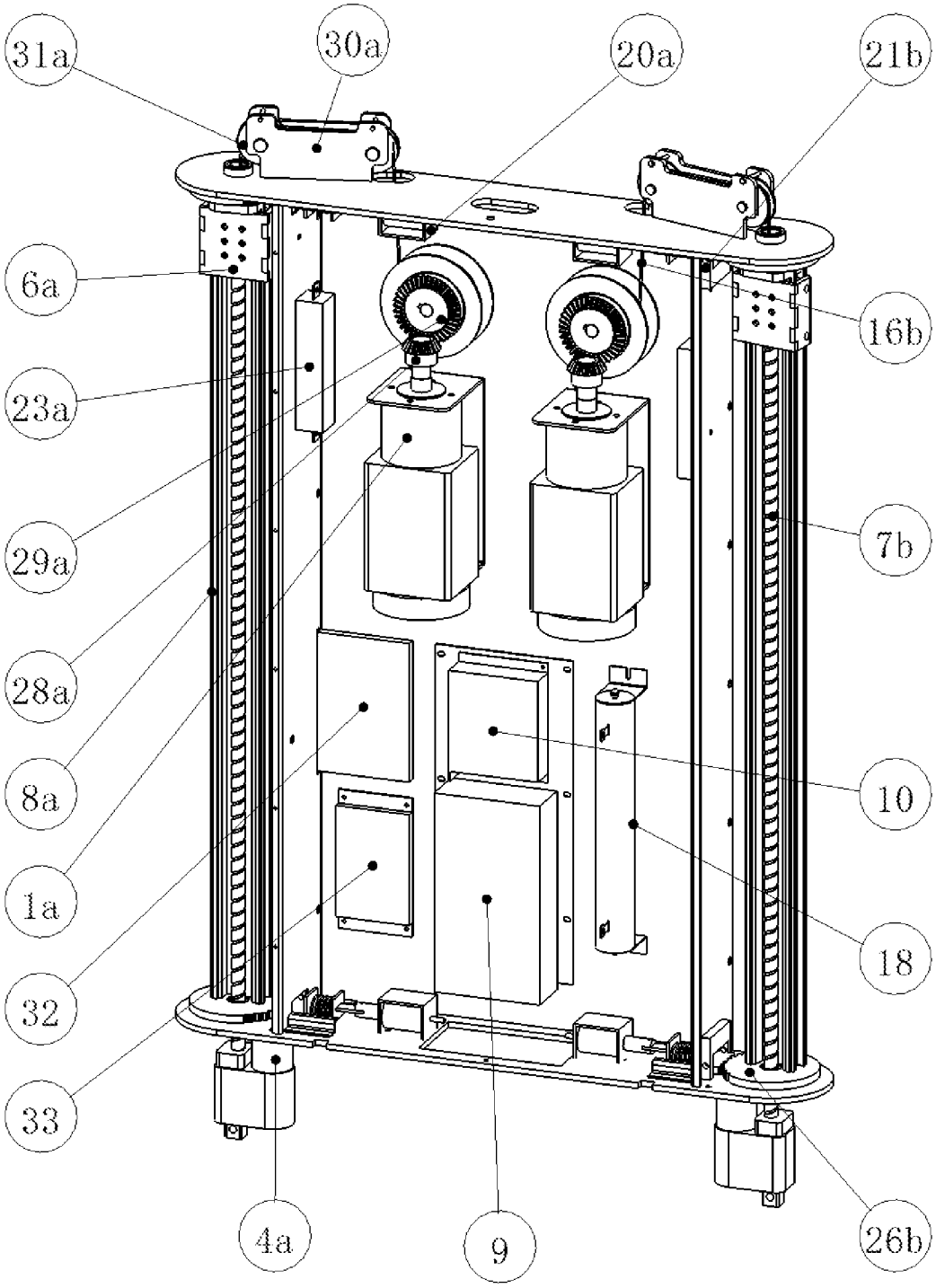
FIG. 4 shows an alternative of FIG. 2. The two motors were installed inside of the device.
Figure 5:
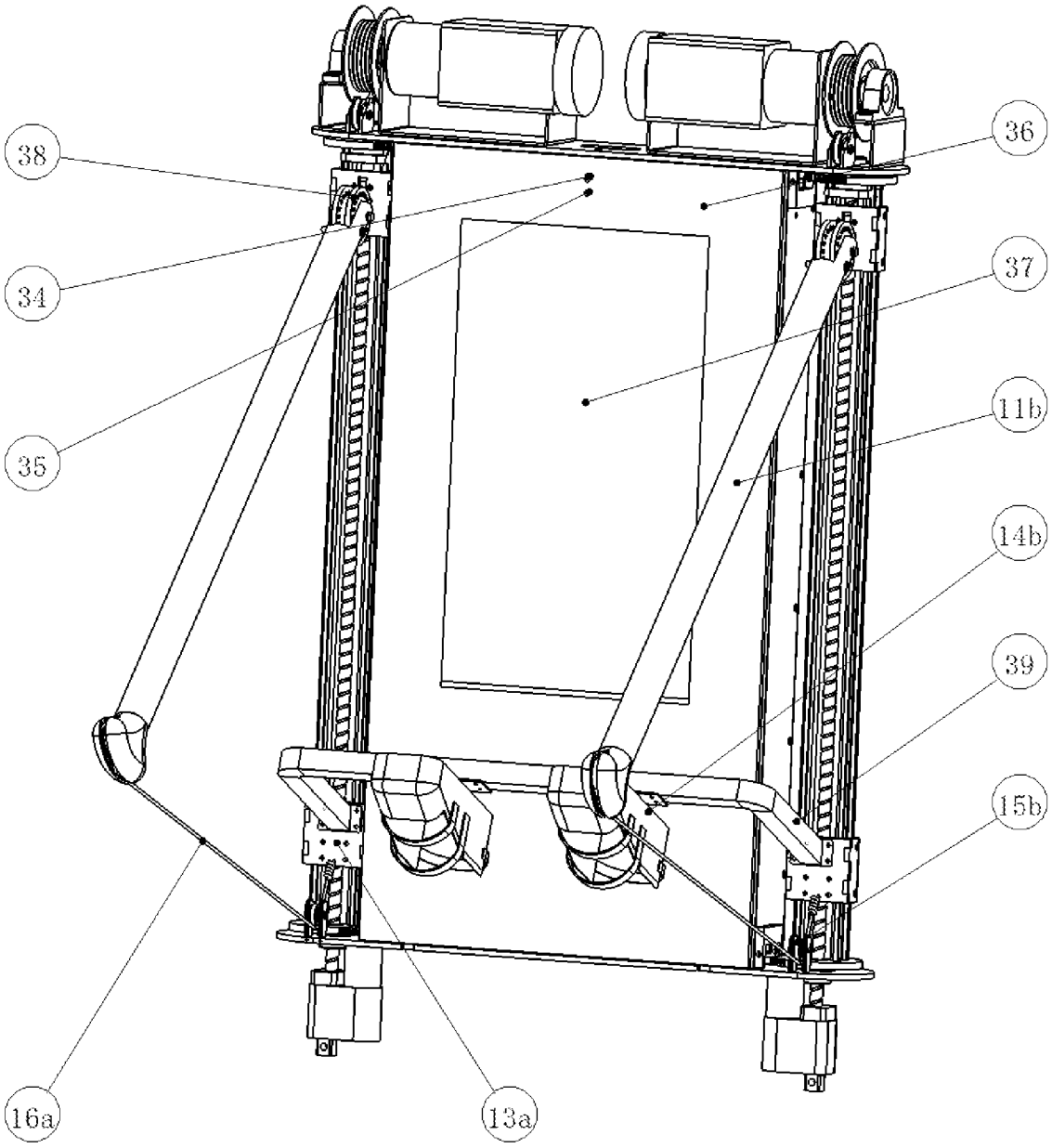
FIG. 5 is a complete structural diagram in accordance with an embodiment of the present invention.

1*a* and 1*b* in FIG. 1 respectively depict two motors on left and right top of the device. They may be BLDC or servo motors. Each motor may generate 100-150 pounds resistance force. They may be cylinder style, cuboid style, or polygon cuboid style that lay across the left and right top of the device. A fan may be incorporated into each motor for cooling when the motor is running. Each motor (1*a* or 1*b*) is mounted solidly on top of the device.

2*a* and 2*b* are two-motor gear reducers each being connected with the two motors 1*a* and 1*b*. A gear reducer is generally used in a transmission device with low rotation and large torque to enable a gear with fewer teeth on an input shaft of the gear reducer to mesh with a large gear on an output shaft so as to decelerate in an electric motor, internal combustion engine or other high-speed device. With disposal of the gear reducer in this device, the motor can be accurately adjusted and controlled to output rotation and power so as to satisfy the requirements of an exerciser for strength stability and safety in a training.

3*a* and 3*b* respectively depict two motors mounted underneath both slide tracks 8*a* and 8*b*. Each of the motors 3*a* and 3*b* connects with a threaded rod 7*a* (or 7*b*). When the motor 3*a* (or 3*b*) spins, it will drive the rod 7*a* (or 7*b*) to spin so as to push and pull the arm deck 6*a* (or 6*b*) up and down along slide tracks 8*a* (or 8*b*). A power on-off button is disposed on the touch screen. These two motors 3*a* and 3*b* help the device to move the arms 11*a* and 11*b* easily and automatically.

4*a* and 4*b* respectively depict gear boxes connected with two motors 3*a* and 3*b* underneath which drive the rod 7*a* (or 7*b*) to rotate at a slow speed. The gear boxes 4*a* and 4*b* make the device much safer.

5*a* and 5*b* respectively depict two spools connected with two top motors 1*a* and 1*b* through the shafts. There are high-strength nylon ropes wound on the spools 5*a* and 5*b*. The end of rope 16*a* (or 16*b*) goes to handle 12*a* (or 12*b*).

6*a* and 6*b* depict two device arm carriages (also referred to as "decks" or "arm decks" hereinafter). These two carriages 6*a* and 6*b* can move up and down on the track (8*a* or 8*b*) under the drive of spinning threaded rod (7*a* or 7*b*). There are six wheels on each side to assist sliding and bear a force.

6*a*-1 and 6*b*-1 depict six wheels underneath each arm deck 6*a* (or 6*b*) to help the deck 6*a* (or 6*b*) to move smoothly. They also stabilize the arm deck 6*a* (or 6*b*) as well.

7*a* and 7*b* respectively depict two threaded rods. The threaded rods 7*a* and 7*b* spin to move the decks 6*a* and 6*b* up and down. When the threaded rod 7*a* and 7*b* spin, they turn toward one direction. The decks 6*a* and 6*b* are pushed up because of their opposite direction threaded. Then, the threaded rod 7*a* and 7*b* change the spin direction, the decks 6*a* and 6*b* are pulled down. One end of threaded rod 7*a* (or 7*b*) connects with underneath gear box 4*a* (or 4*b*). Another end is fixed on top of the frame.

8*a* and 8*b* respectively depict two slide tracks. The threaded rod (7*a* or 7*b*) is inside it. A deck 6*a* (or 6*b*) sits on top of each track 8*a* (or 8*b*). The threaded rod (7*a* or 7*b*) spins to drive the deck 6*a* (or 6*b*) to move. There are six wheels 6*a*-1 (or 6*b*-1) underneath deck 6*a* or 6*b* to help the deck 6*a* (or 6*b*) to move smoothly.

9 depicts four motor drive boards. Each individual motor (1*a*, 1*b*, 3*a*, or 3*b*) has its own drive board 9. Software is installed in the drive board 9.

10 depicts power source, which supplies a constant or dynamically changing voltage, current and resistance to four motors (1*a*, 1*b*, 3*a*, or 3*b*).

11*a* and 11*b* respectively depict device arms. The arms 11*a* and 11*b* may be adjusted to different positions by deck 6*a* or 6*b* 's move and slide track (8*a* or 8*b*)'s move.

12*a* and 12*b* respectively depict handles as an example of accessories or parts that can be connected with the arm (11*a* or 11*b*). The handle (12*a* or 12*b*) is connected with arm (11*a* or 11*b*) by a connector. It may be connected with bar, rope or other exercise parts.

13*a* and 13*b* respectively depict another two carriages on the lower left and right slide tracks 8*a* and 8*b*. They have six wheels 6*a*-1 (or 6*b*-1) sliding on the slide tracks 8*a* and 8*b*.

The two carriages 13*a* and 13*b* are provided with holes for inserting fixed short rods on the left and right sides of the footboard for mounting one footboard.

14 illustrates a footboard 14. The footboard 14 is detachable and inclined at a particular angle. There is one short rod at the left and right sides respectively for being inserted into the left and right carriages 13*a* and 13*b* and then clamped by clamping pins of the carriages or tightened by screws. The footboard 14 can slide up and down with a load due to the supporting of the left and right carriages 13*a* and 13*b*. A tensioned rope is led from the arm (11*a* or 11*b*) of the device above and passed through the pulleys 15*a* and 15*b* and then fixed on the carriages 13*a* and 13*b* at both sides respectively. An exerciser may lie on a long bench with feet on the footboard 14 to resist pull forces generated by the left and right motors (1*a* and 1*b*), so as to train the leg muscles.

15*a* and 15*b* depict two pulleys with concave grooves. Because the pulleys 15*a* and 15*b* are fixed at left and right sides of the bottom of the device, they can swing left and right freely. They may automatically adapt their angle and direction to a direction of the rope 16*a* (or 16*b*) leading from the arm (11*a* or 11*b*) of the device above, thereby preventing the rope 16*a* or 16(*b*) from slipping out of the concave groove of the pulleys 15*a* and 15*b*.

16*a* and 16*b* depict two ropes. Each rope has two ends. One end is connected to a handle 12*a* (or 12*b*) and another end twines on a spool 5*a* (or 5*b*).

17*b* depicts a bearing pedestal of a spool 5*a* or (5*b*), in which one shaft rotatable with 5*a* or (5*b*) is mounted on a bracket. When the rope is pulled from the distal end of the arm, a downward tension transmitted can be shared, there protecting 5*a* or (5*b*) from being bent.

18 depict a discharge resistor. It is connected in parallel with the output of a high voltage power supply circuit with the express purpose of discharging the residual electric charge stored in the filter capacitors of the power supply.

19 depicts a side wall of the device, on which a plurality of screw holes are disposed to be connected with screw holes on a bracket mounted on the wall through screws so as to ensure the device can be tightly fixed on the wall.

20*b* depicts an electromagnetic tensioner, which can produce a pull force once powered on to pull a far-end spring to shrink and thus disengage a far-end latch from a circular wheel disk on ARM, such that the ARM adjusts position by loop rotation.

21*b* depicts a reinforced portion on a side wall 19. This portion is a thickened square iron frame welded into the side wall of the device because this portion will receive a strong torsion transmitted by the far-end latch of the electromagnetic tensioner from the ARM top wheel disk.

22*a* depicts a fan which is used to dissipate heat generated by a motor during a running process.

23*a* depicts a speaker for playing audio contents.

24*a* depicts a small pulley for aligning the rope on 5*a* to accurately enter slide track, thus avoiding friction with surroundings. In this way, the power of the motor can be smoothly transmitted to the distal end of the arm.

25*a* depicts a small pulley for driving the ARM DECK to slide on the slide track. Each ARM DECK has six pulleys which are clamped in the slide track, to prevent the ARM DECK from being pulled off the slide track when pulling the rope on the arm.

26*a* depicts a slide track position adjusting gear. When the electromagnetic tensioner works, the distal end latch will be disengaged due to shrinkage of spring connected to the electromagnetic tensioner. At this time, the gear can be rotated by rotating the ARM manually to adjust the entire slide track to a different position, so as to satisfy the requirements for different positions for strength trainings of the muscles of different body parts. When the electromagnetic tensioner stops working, the distal end spring will push the latch to engage on the position adjusting gear due to its elastic force, thereby locking the slide track at a fixed position.

27*a* depicts a portion of the top of a threaded rod embedded into 26*a*, which is a square metal block with four corners being well clamped into an inner ring of the position adjusting gear, thereby realizing linkage.

28*a* depicts a bevel gear which is a driving wheel directly connected with a shaft of a gear box on the motor and rotates along with rotation of the shaft.

29*a* depicts a bevel gear which is a driven wheel coupled with 28*a* to change a transmission direction of the power of the motor, i.e., changes a transverse power into a longitudinal power so as to facilitate mounting spool. This way, the spool can be paralleled to device housing, thereby reducing a thickness of the entire device.

30*a* depicts a device top pulley fixing bracket in which at least two pulleys are mounted to transmit the power of the motor to the arm through the rope. One of the at least two pulleys leads the rope into the slide track and the other is directly connected to the spool.

31*a* depicts a pulley leading the rope into the slide track on the device top. This pulley is a pulley with a concave groove along outer circumference for the rope to run through. The pulley is made of metal or plastic.

32 depicts a power source of a display screen, which is a direct current power source.

33 depicts a driving board of threaded rod motors for controlling start, stop, velocity and stroke and the like of the threaded rod motors.

34 depicts a camera for remote exchange between an instructor and a trainee. At the same time, the camera can capture 3D bone points of a human body to correct wrong practice actions of the trainee under the analysis of AI.

35 depicts a microphone for remote exchange between an instructor and a trainee or between trainees.

36 depicts a mirror layer covered on the LED display screen 37. In this case, when a trainee practices, the trainee may see the contents played on the display screen while seeing his/her own mirror image through the mirror layer, thereby facilitating correcting actions in time.

37 depicts an LED display screen for playing fitness video contents. This is a touch screen on which operations can be made directly by a finger.

38 depicts a semi-circular bracket, the bottom of which is welded to the carriage. One row of round holes arranged annularly are disposed on the bracket. Pins can be inserted through the round holes and also through the distal end hole of the ARM, so as to tightly fix together the ARM and the carriages. The arm can be fixed at a different position on the carriages by changing a different hole on the bracket, so as to meet the requirements of arm for different positions during strength exercise.

39 depicts a bracket of a footboard. The bracket is detachable. When the lower limbs practice strength trainings, the bracket can be mounted. Both ends of the bracket are connected to the carriages on the slide tracks at the left and right sides respectively. The bracket can be directly inserted into small hollow columns of the carriages and then tightened with a thick screen.

In addition to the above descriptions, various modifications may be made to the embodiments and implementations of the present invention without departing from the scope of protection of the present invention. Thus, the accompanying drawings and examples herein are merely intended to be non-limiting. The scope of protection of the present invention is only indicated by the appended claims.

I claim:

1. An exercise device comprising:

a main body, wherein the main body has an upper part, a lower part, and a front surface;

at least two upper motors of a cylinder style or cuboid style or polygon cuboid style being mounted at the upper part of the main body, wherein each of the upper motors is configured to produce adjustable and dynamic resistance;

at least two gear reducers, with one of the two gear reducers being connected with one of the two upper motors, and the other one of the two gear reducers being connected with the other one of the two upper motors, wherein each of the at least two gear reducers has an axle;

at least two spools, with one of the two spools being mounted on the axle of one of the at least two gear reducers, and the other one of the two spools being mounted on the axle of the other one of the at least two gear reducers;

at least two movable arms slidably attached to the main body, wherein each of the movable arms comprises a rope having two ends, with one end being connected to a handle, and the other end being connected to one of the at least two upper motors through one of the at least two spools, with one of the two movable arms being connected with one of the at least two upper motors, and the other one of the movable arms being connected with the other one of the at least two upper motors;

at least two lower motors for facilitating moving the at least two moveable arms, with the at least two lower motors being mounted on the lower part of the main body, a display device disposed at the front surface of the main body, wherein the display device comprises an interactive touch screen;

an intelligent control system operably coupled with at least one of the display device, upper motors, and lower motors, wherein the intelligent control system comprises a central controller to control at least one of the upper motors, lower motors, and the display devices; and the device is mountable on a wall and/or is capable of standing alone on ground.

2. The device of claim 1, wherein the display device comprises an electronic display layer to display video imagery of a fitness instructor.

3. The device of claim 1, wherein the display device comprises a mirror reflection layer to reflect an image of a user opposite the display device.

4. The device of claim 1, further comprising a dismountable footboard attached on the lower part of the main body so that a user may lie on a bench with feet on the footboard to resist pull forces generated by the at least two upper motors the left and right motors and therefor train leg muscles of the user.

5. The device of claim 4, wherein the main body has a left side and right side, the left side comprises an upper left side and a right left side, the right side comprises an upper right side and a lower right side, the device comprises a left slide track on the left side, and a right slide track on the right side, two lower carriages with one being slidably attached to the lower left side of the main body and the other one being slidably attached to the lower right side of the main body, and the dismountable footboard on the lower part of the main body through connection with the two lower carriages for facilitating lower body exercise.

6. The device of claim 1, wherein the main body has a left side and right side, the left side comprises an upper left side and a lower left side, the right side comprises an upper right side and a lower right side, the device comprises a left slide track on the left side, and a right slide track on the right side, two upper carriages with one being slidably attached to the upper left side of the main body and the other one being slidably attached to the upper right side of the main body, and the at least two movable arms slidably attached to the main body through connection with the two upper carriage for facilitating upper body exercise.

7. The device of claim 6, wherein the device comprises at least two threaded rods operably coupled with the at least two lower motors for moving the arms up or down the left slide track and right slide track respectively at a desired position, with one threaded rod being disposed on the left side of the main body, and the other threaded rod being disposed on the right side of the main body.

8. The device of claim 1, further comprising a camera disposed on the upper part of the main body, wherein the camera is configured to collect image and/or exercise information and/or data of the user.

9. The device of claim 1, wherein each of the at least two upper motors contains a sensor for counting velocity and step length.

10. The device of claim 1, wherein at least one of the at least two upper motors is a three-phase brushless direct-current (BLDC) motor or servo motor.

11. The device of claim 1, wherein the device is configured with artificial intelligence (AI) to learn muscle strength of both an exerciser and to output personalized resistance weight for the exerciser.

12. The device of claim 1, wherein the device is configured to adjust the resistance through voice recognition technology.

13. The device of claim 1, wherein the device is configured to output different resistance simultaneously by adjusting each of the at least two upper motors separately.

14. The device of claim 1, wherein each of the two upper motors and lower motors is coupled with a drive board.

* * * * *